United States Patent [19]

Krupp et al.

[11] Patent Number: 4,977,023

[45] Date of Patent: Dec. 11, 1990

[54] ELASTIC CARBON FIBERS

[75] Inventors: Stephen P. Krupp, Houston, Tex.; Scott L. Gessner, Greenville, S.C.

[73] Assignee: The Dow Chemical Company, Midland, Mich.

[21] Appl. No.: 221,843

[22] Filed: Jul. 20, 1988

Related U.S. Application Data

[60] Division of Ser. No. 907,931, Sep. 16, 1986, and a continuation-in-part of Ser. No. 700,231, Feb. 11, 1985, abandoned, and a continuation-in-part of Ser. No. 944,479, Dec. 22, 1986.

[51] Int. Cl.[5] ..... D02G 3/00

[52] U.S. Cl. ..... 428/367; 208/22; 208/40; 423/447.1; 423/447.4; 428/408

[58] Field of Search ..... 428/367, 408; 423/447.1, 447.4; 208/22, 40

[56] References Cited

U.S. PATENT DOCUMENTS

| | | | |
|---|---|---|---|
| 4,497,789 | 2/1985 | Sawran et al. | 423/447.4 |
| 4,554,148 | 11/1985 | Gomi et al. | 423/447.1 |
| 4,591,424 | 5/1986 | Gomi et al. | 208/40 |
| 4,671,864 | 6/1987 | Sawran et al. | 208/22 |

*Primary Examiner*—Lorraine T. Kendell

[57] ABSTRACT

A fiber made of pitch is disclosed. In the preferred and illustrated embodiment, the fiber has a percent elongation of about 2 percent or greater. This fiber is made by melt spinning an optically isotropic pitch to form a fiber typically in the range of about 5 to about 50 microns diameter, treating the fiber with an oxidizing atmosphere, subsequently removing a certain portion of the oxidant thereby reducing the weight of the fiber, with the optional post-treatment step of repetitively stretching in the elastic range short of breakage to increase the percent elongation.

17 Claims, No Drawings

ELASTIC CARBON FIBERS

This disclosure is a continuation in part of application Ser. No. 700,231 filed Feb, 11, 1985, now abandoned, and also of application Ser. No. 944,479 filed Dec. 22, 1986, and also is a division of application Ser. No. 907,931 filed Sept. 16, 1986. All the cited applications are assigned to a common assignee and are incorporated by reference.

BACKGROUND OF THE DISCLOSURE

The foregoing disclosure sets forth a pitch which enables carbon fibers to be made by drawing. The carbon fibers made from the pitch have physical characteristics which are in part described by the foregoing disclosure. Separate from that disclosure, it has been additionally discovered that a carbon fiber made with the pitch set forth in that disclosure can be treated during processing to thereby obtain an elastic fiber.

Elastic fibers find great use and application in various and sundry yarn manufacturing procedures and also in the making of cloth or fabrics from such yarns. Yarn manufacturing equipment involves rough handling of the fibers used to make the yarn, and subsequent processing by other equipment is also rough on the fibers making the yarn and cloth made therefrom. For these reasons, it is very important to have a fiber which is not brittle and which has a minimum measure of elongation. Most yarn manufacturing equipment requires a minimum of about two percent elongation of the individual fibers to enable the machinery to operate properly. An alternate use of the fiber of the present invention is shown in U.S. Pat. No. 4,647,360, assigned to present assignee.

It has been discovered that controllable elongation in carbon fibers is very important to obtaining a suitable fiber, that is, a fiber which can be used by typical yarn and cloth manufacturing equipment. The present fiber qualifies on these important criteria and is thus described as a fiber which is suitable for spinning and weaving. Moreover, the fiber of the present disclosure and the method of manufacture for making the fiber describes a fiber which has a controllably high percent elongation The physical characteristics of the fiber of this disclosure can be modified over a range by post-manufacture treatment to increase the percent elongation. In such an instance; controllable elongation can be obtained. An important feature of the present disclosure is the provision of a fiber which has a significant elastic range with substantially no plastic range. This defines a fiber which can be relied on to return to its original length after stressing. On return to its original length, it still has approximately the same load-bearing capacity, this capacity being unchanged by virtue of the fact that there is no plastic elongation in the fiber.

With the foregoing in mind, the present disclosure is thus summarized as a method of manufacture of a special fiber and the fiber having specific physical characteristics. The method of manufacture utilizes a pitch of a specific description for melt spinning to form a fiber and subsequent treatment after drawing. The post drawing treatment includes oxidizing, preferably with a chlorine atmosphere for a specified interval. Other oxidants can be used including oxygen or air mixed with $NO_2$ serving as a catalyst. The weight of the fiber is increased by chlorine oxidation preferably to about 20 percent, and within the range of about 15 to about 40 percent.

Extent of oxidation is an important process parameter; percent weight gain is a rough estimate of oxidation. The percent increase is different with different oxidants. Further, oxidation can be evaluated by factors other than percent weight change. After oxidation with a selected oxidant and the subsequent increase in weight, the fiber is then subjected to a heated atmosphere, steadily increased to avoid fiber destruction in a processing step known as dehydrohalogenation. The processing step is labeled differently should a nonhalogenic oxidant is used. This then yields a fiber having a relatively large percent elongation, controllably typically in the range of 2 up to a larger percent. The elongation can be increased thereafter by repetitively stressing the fiber through several cycles (typically 3 1 to 10) wherein the stress applied is perhaps 25–75 percent of the tensile strength of the fiber. After stressing, the fiber will evidence an increased percent elongation, typically above 5 percent and perhaps as high as 7 percent. At this juncture, the fiber may still be described as responding as an elastic member having substantially no performance in the plastic range.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other effective embodiments.

FIG. 2 graphs several physical properties as a function of heat treatment temperature for fibers made of a selected pitch;

FIG. 3 plots several curves of fiber weight loss as a function of heat treatment temperature for pitch fibers oxidized to different degrees, as determined by percent chlorine;

FIG. 6 plots physical properties as a function of heat treatment temperature for fibers oxidized with oxygen in the presence of nitrogen dioxide.

DETAILED DESCRIPTION OF THE PREFERRED EMBODIMENT

Figure 1A:
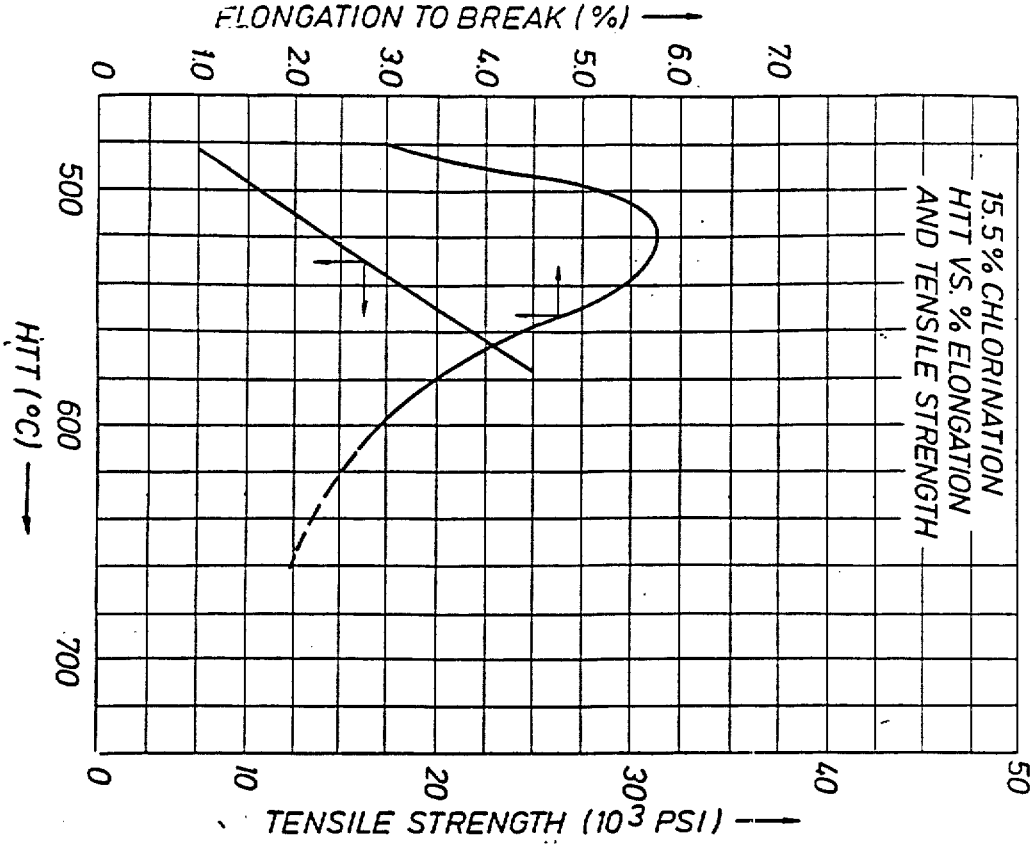
FIG. 1 is a set of several curves showing physical property variations as a function of heat treatment temperature for different percent chlorination.

A specific pitch is used as the feed for manufacture of fibers in accordance with the present disclosure. As set forth in the referenced disclosure, the pitch is characterized by using substantially isotropic, which means that it is essentially free of optically observable anisotropic pitch, having a softening point in the range of about 130° to 300° C., a percent quinoline insoluble content of less than about 1 percent and a Conradson carbon measure of 50 or more. This preferred feed material is used to make fibers by suitable drawdown through the use of equipment well known for fiber spinning. The completed fiber, depending on the mode of operation of the drawing equipment, can have a diameter as low as about 5 microns on up to about 50 microns. A fiber manufactured with this particular feed forms a fiber suitable for processing in accordance with the present disclosure to thereby make the elastic pitch fiber of the present disclosure.

The fiber described above is next treated with specific processing steps to render the fiber infusible via oxidation. It is exposed to an oxidizing atmosphere of a sufficient amount of chlorine mixed with an inert gas (typically nitrogen) to increase the weight of the fiber to something in the range of about 15 percent to about 40 percent. This increase in weight is accomplished substantially at room temperature with chlorine. Oxidants other than chlorine can be used and will provide different percent weight increases In a typical and successful oxidation step, the gases (pure chlorine or with an inert gas) are flowed over and around the fiber at a gas flow velocity of perhaps 1 m/sec. The velocity is kept relatively low to avoid physically disturbing the fiber because it is normally brittle at this stage of processing. This processing step is carried out typically at ambient temperature and ambient pressure The oxidization atmosphere is delivered to the vicinity of the fiber for several minutes This processing step can be extended from just a few minutes up to about one hour. Success has been obtained heretofore by continuing the oxidation step for 18 minutes in an atmosphere of about 5 to about 10 percent chlorine gas, the remainder of the gas being nitrogen. If multiple fibers are treated, and this would ordinarily be the case in the handling of fibers on a batch basis, some heat is liberated and, accordingly, the fibers cannot be packed too tightly. Excessive packing may create excessive heat on certain of the fibers which will be damaged at this stage of processing. Accordingly, the packing density is reduced or, alternatively, the gas in which this processing step is carried out is cooled slightly to assure that spot temperatures on the interior of the container do not rise significantly above the ambient level.

Specimen fibers (normally several fibers) can be tested to determine the percent weight increase. The percent weight range, as mentioned above, is about 15 percent to about 40 percent. This range encompasses the optimum of about 20 percent weight increase. These values are preferred where the oxidant is chlorine. It has been discovered that oxidation to about 40% by weight chlorine yields a fiber with less percent elongation for a given heat treatment temperature sequence than a fiber processed to about 20% by weight chlorine. Thus, a reduced percent oxidant generally defines a fiber which is more resilient with the same processing.

The next processing step involves dehydrohalogenation. This is accomplished in a heat treatment cycle. The oxidized fiber is next exposed to an atmosphere of inert gases and is heated. The inert gases preferably flow continuously around the fiber to carry off liberated gases from the fiber. The temperature of the fiber is raised. There is a limitation on the rate at which it can be raised. There is a type of annealing which occurs in this processing step. Accordingly, the fiber cannot be shocked by instant exposure to an elevated temperature. The temperature is therefore raised steadily. The actual temperature thus lags behind the partially and finally annealed maximum permissible temperature. As this is increased, the instantaneous permitted or maximum temperature will increase more rapidly, thereby enabling an increased rate of heating. It has been discovered that a reasonable rate of heating for the fiber of the present disclosure involves raising the temperature from ambient to about 100° C. in about one hour. Ambient is typically in the range of 20° to 25° C., and the increase to 100° C. at this rate then prepares the fiber for even further increase. The temperature is then increased at a rate of perhaps 2° C. per hour to a peak treatment temperature of about 500° C. The peak temperature is sustained for an interval ranging from just a few minutes upwards to about 24 hours.

Using a set of chlorinated fibers having an approximate 20 percent weight increase during the oxidation step, and accomplishing the dehydrohalogenation with the temperature increases to about 500° C. as described above, about half of the added weight is lost in this process. The percent weight loss is relatively independent of the duration at which the maximum temperature is sustained. If, for instance, the maximum temperature is obtained for just a few minutes or several hours, the percent weight loss is about the same. In this instance, the maximum temperature need not be determined with great precision. The peak temperature accomplished should be in the range of at least about 420° C., the preferred peak being about 500° to 520°. Higher peak temperatures can be used but they do not seem to significantly further contribute to the percent elongation characteristics described for the present fiber. The heat treatment temperature profile may vary with a change in oxidant.

The fiber is cooled to room temperature in just a few minutes. Upon reaching room temperature, the fiber at this point can then be used in the manufacture of yarn by conventional spinning apparatus. At this juncture, the fiber will typically have, for fibers in the range of about 6 to about 15 microns diameter, a tensile strength up to about 22,000 psi with approximately 5 percent elongation. This defines a fiber having a Young's modulus of about $0.4\times10^6$ psi. At this point, the fiber is suitable for use in spinning into yarn.

As an alternate subsequent step, fibers made in accordance with the process described above can be repetitively stretched. Stressing through an elongation less than maximum seems to increase the maximum elongation. In typical cycles, perhaps 3 to 10 cycles of stressing, the fibers can be pulled short of breaking to thereby increase the percent elongation. For instance, if the fibers are stressed to something on the order of 25 to 75 percent of maximum elongation as originally measured, after about 3 to about 10 cycles of stretching, the fibers then would show an increase percent elongation. If the original fibers have an elongation of about 5 percent to break, the stretching seems to increase the percent elongation to something in the range of about 6.1 to about 8.0 percent. Thus, this stretching step will be characterized as providing an additional about 20 to about 40 percent elongation to break. Regarding the number of stretch cycles 3 to 10 seems to gain some improvement. The fiber may benefit on applying a greater number of stretching cycles; however, increasing the number of stretch cycles indefinitely does not seem to greatly enhance fiber elongation over that obtained with just a few cycles of stretching.

The stretching sequence can be carried out by any suitable fiber stretching apparatus. An important factor to note is that there is no plastic flow upon such stretching. Rather, the fiber length is elastic (not plastic) as a result of the stretching process. The stretching process is able to obtain stretching without moving the zero point for stretching because there is no plastic flow.

An important factor to note from the foregoing is that it provides a fiber which has an elastic range but substantially no plastic range in its physical properties.

From the foregoing, it will be observed that alternate procedures can be used to provide fibers having an elongation of perhaps 4 percent, but typically 5 percent and sufficient to enable use with fiber spinning and yarn manufacturing equipment. With the post manufacture stretching step added, the change from about 5 percent to at least 6 and upwards of about 8 percent yields what is cautiously defined as about 20 to about 40 percent additional elongation.

REPRESENTATIVE MEASUREMENTS

The carbon fiber made by the present process have a finished diameter in the range of about 5 to about 50 microns with a percent elongation of 2% or more as set forth. The elongation is elastic, not plastic so that it can be fairly said that the fiber stretches in the elastic range but does not have a plastic range. The completed carbon fiber is impervious to most chemicals including strong acids and bases. It is impervious to common hydrocarbon solvents such as benzene, toluene and carbon tetrachloride.

Physical properties should be noted. Tensile strength is typically in excess of 10,000 psi while Young's modulus is at least about $0.4\times10^6$ psi. On repetitive stretching as described above, the tensile strength typically exceeds 10,000 psi. Measurements of physical properties show a surface area that can be as low as 100 $m^2/gm$ and up to about 600 $m^2/gm$ or more. Electrical conductivity, or more aptly, electrical resistivity is shown in table 1 below.

Table 1 describes fiber resistivity. The left hand column sets forth the heat treatment temperature achieved for the fiber. The right hand column describes the resistivity of a single fiber in ohm-centimeter units. The resistivity changes markedly between about 610° C. and higher temperatures. The data from Table 1 was obtained from a fiber oxidized by the $NO_2$/air mix flowing with a 1% (volume) $NO_2$ catalyst.

TABLE 1

| HTT (C.°) | Single Filament Electrical Resistivity in ohm-cm |
|---|---|
| 480 | ∞ |
| 550 | ∞ |
| 610 | ∞ |
| 750 | 1.75 |
| 850 | $8.86\times10^{-3}$ |
| 980 | $9.17\times10^{-3}$ |

Important additional physical properties of the completed fiber include heat resistance to a significant high value, perhaps in excess of 1,500° C. and likely as high as 2,500° C. Additional important factors include the fact that a fiber is impervious to most chemicals and is substantially inert in use. It is not easily broken and can otherwise bend, flex and tolerate substantial physical abuse in application 20 While the foregoing is directed to the preferred embodiment, the scope thereof is determined by the claims which follow.

What is claimed is:

1. An oxidized stabilized nonmesophase pitch fiber having a diameter in the range of about 5 to 50 microns diameter, having a percent elongation to break of at least about 2 percent and sufficient to enable machine handling in an elastic range with no plastic range, said fiber also having a tensile strength of at least about 10,000 psi, a Young's modulus of at least about $0.4\times10^6$ psi and a surface area as low as 100 $m^2/gm$ and up to about 600 $m^2/gm$.

2. The fiber of claim 1 wherein the fiber is impervious to most chemicals and is heat resistant when subjected to exposure of temperatures up to about 2500° C.

3. The fiber of claim 1 wherein the fiber has a diameter in the range of about 5 to about 15 microns.

4. The fiber of claim 1 wherein the electrical resistance is about $10^{-2}$ ohm-cm.

5. The fiber of claim 1 having a percent elongation at break in the range of about 5% to about 8%.

6. The fiber of claim 1 prepared by oxidizing a pitch fiber having essentially no mesophase content to an oxidation extent and subsequently heat treating in an inert atmosphere to a heat treatment temperature of at least about 420° C.

7. A fiber as in claim 6 having a diameter of from about 5 to about 15 microns.

8. A fiber as in claim 6 having electrical resistivity of about $10^{-2}$ ohm-cm.

9. A fiber as in claim 6 having elongation of about 8%.

10. A fiber as in claim 6 wherein said heat treatment temperature is between about 500° C. and 520° C.

11. The fiber of claim 6 wherein said fiber is heat resistant when subjected to exposures of temperatures up to about 2,500° C.

12. The fiber of claim 1 wherein said fiber is electrically non-conductive.

13. The fiber of claim 1 wherein the fiber is an elongate isotropic fiber.

14. The fiber of claim 6 wherein said fiber is electrically non-conductive.

15. An oxidized stabilized nonmesophase pitch fiber, comprising an elongate isotropic fiber having a surface area as low as 100 $m^2/gm$ and up to about 600 $m^2/gm$, having a percent elongation at break of at least about 2 percent and sufficient to enable machine handling, having a diameter of about 5 to about 50 microns, having a tensile strength within the range from about 10,000 psi up to about 22,000 psi and having a Young's modulus of at least about $0.4\times10^6$ psi.

16. The fiber of claim 6 wherein said fiber has a tensile strength up to about 22,000 psi.

17. The fiber of claim 6 wherein said heat treatment temperature is within the range of from at least about 420° C. to about 520° C.

* * * * *

UNITED STATES PATENT AND TRADEMARK OFFICE

CERTIFICATE OF CORRECTION

PATENT NO. : 4,977,023

DATED : Dec. 11, 1990

INVENTOR(S) : Stephen P. Krupp, et al.

It is certified that error appears in the above-identified patent and that said Letters Patent is hereby corrected as shown below:

The title page should be deleted to appear as per attached title page.

Figure 1B:
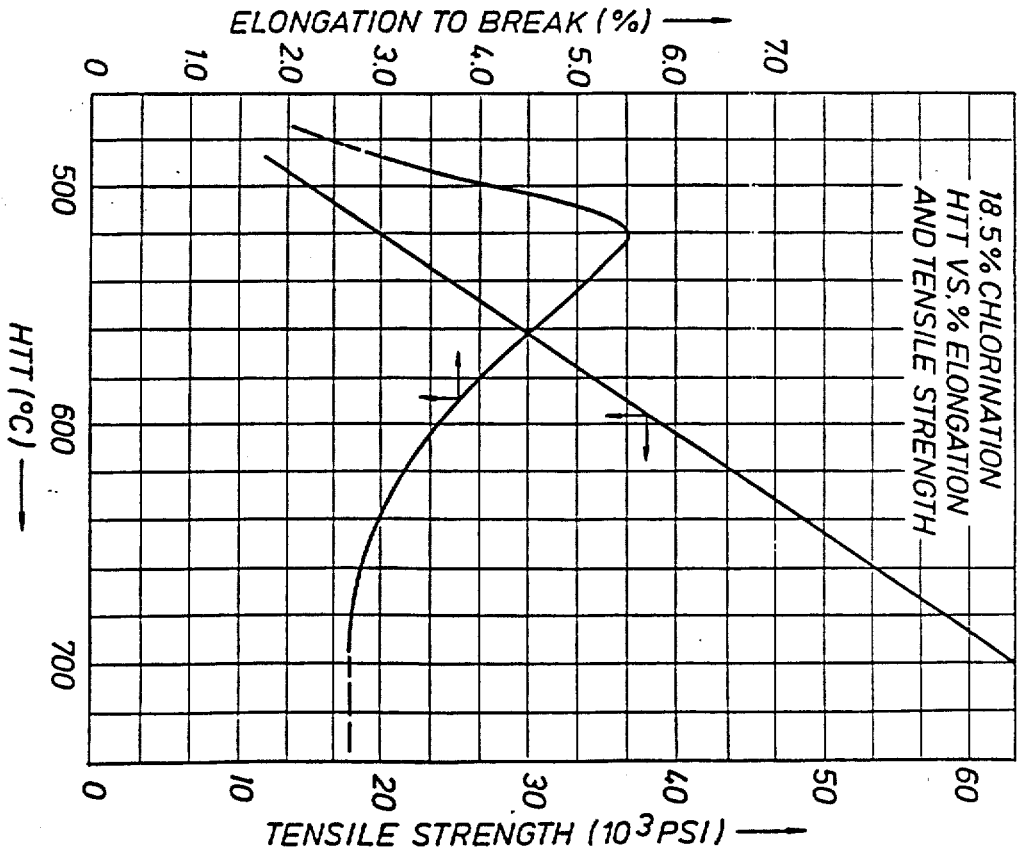
Figure 1C:
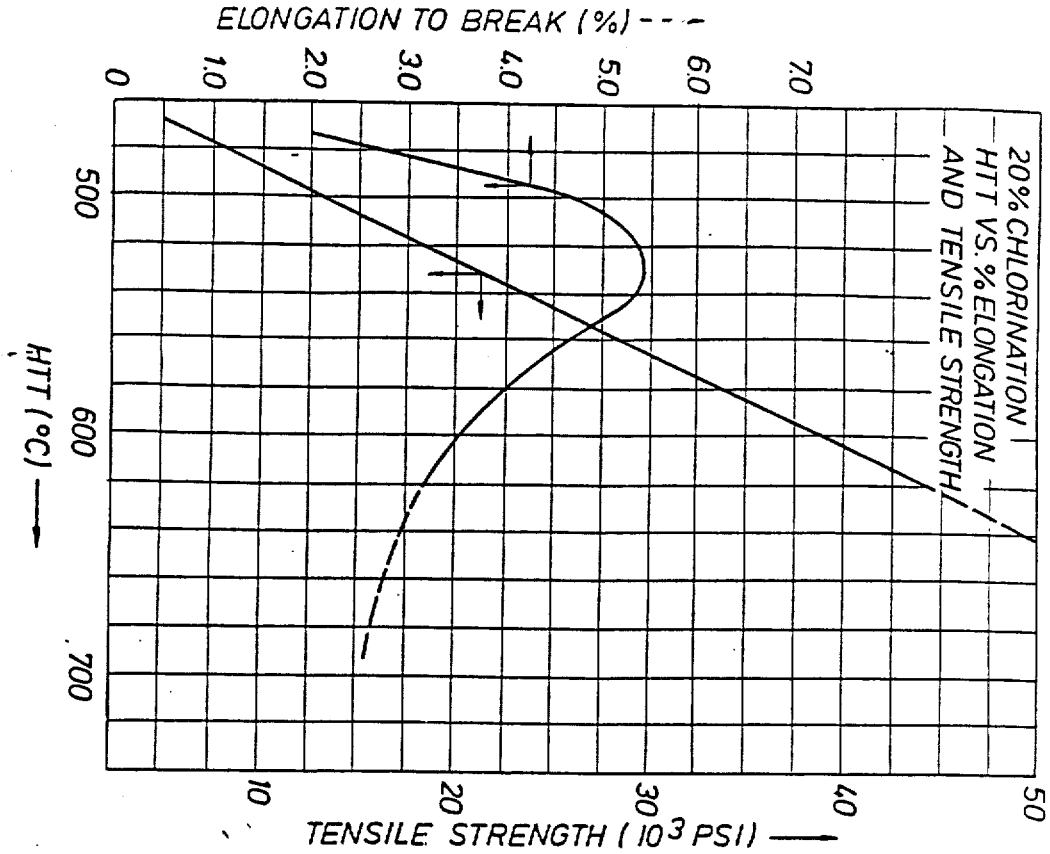
Figure 1D:
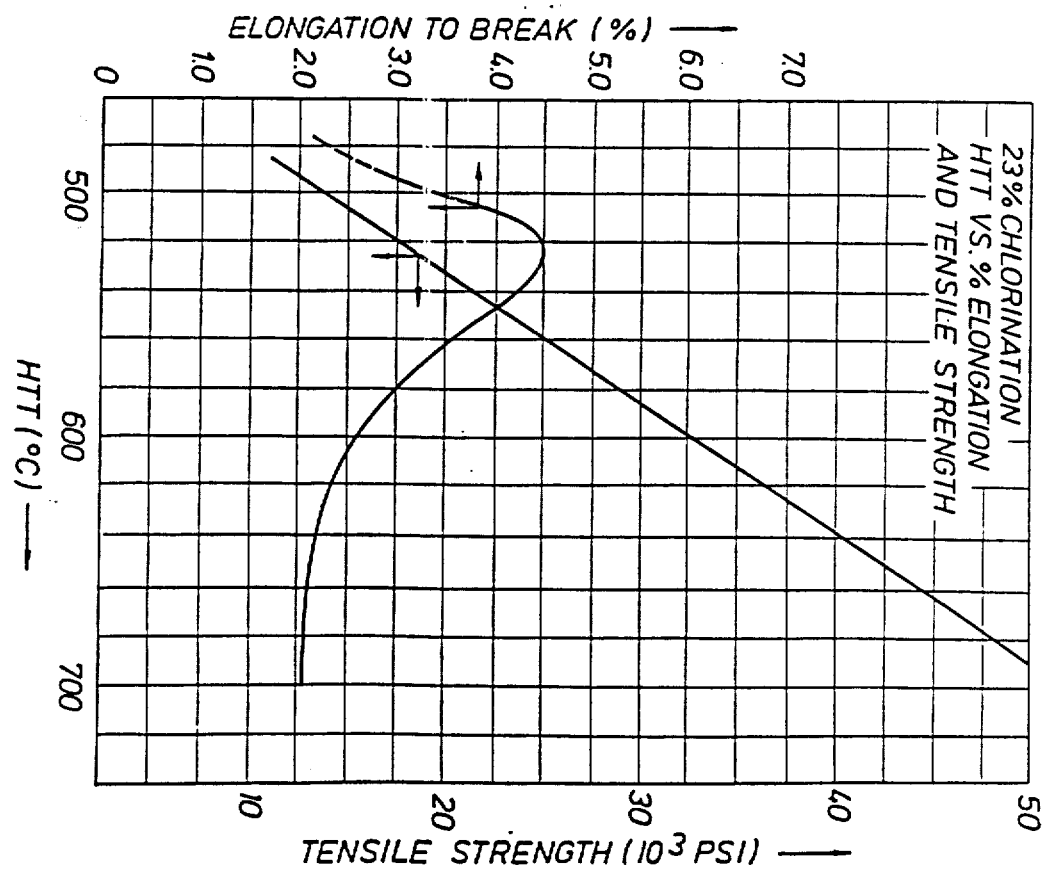
Figure 4:
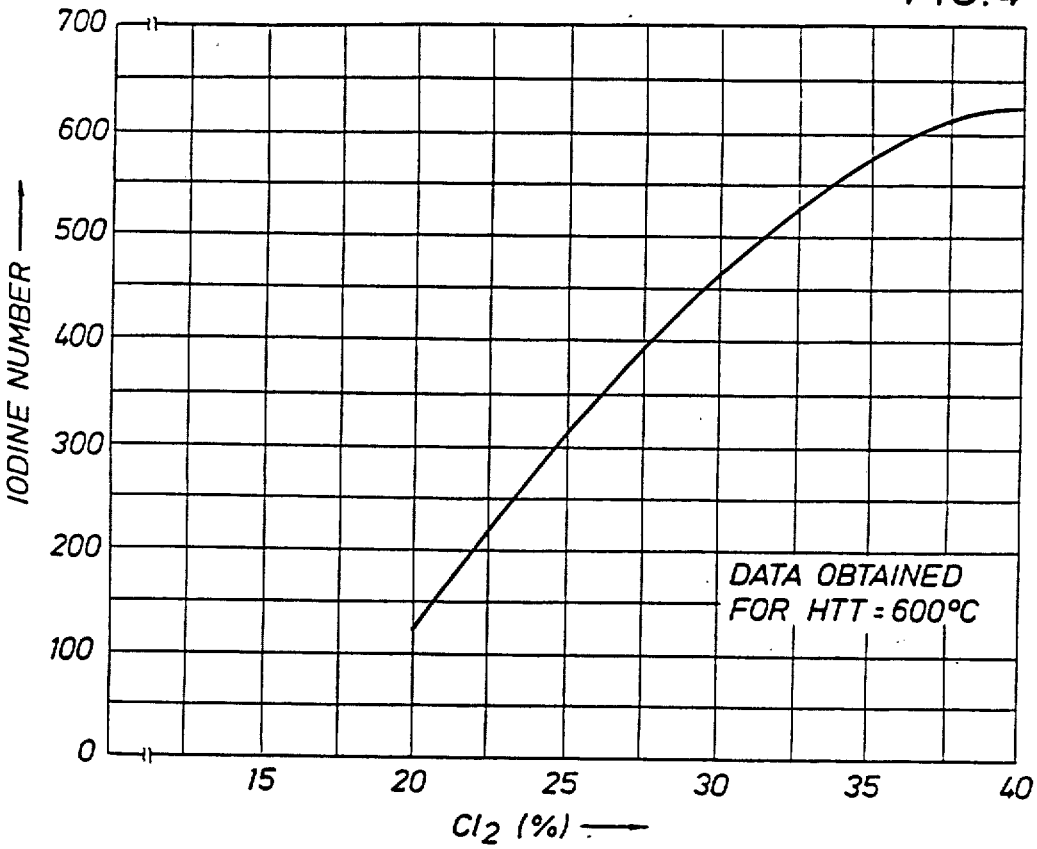
FIG. 4 plots iodine number (inferring surface area) as a function of percent chlorine weight gain in fibers at a single heat treatment temperature.
Figure 5:
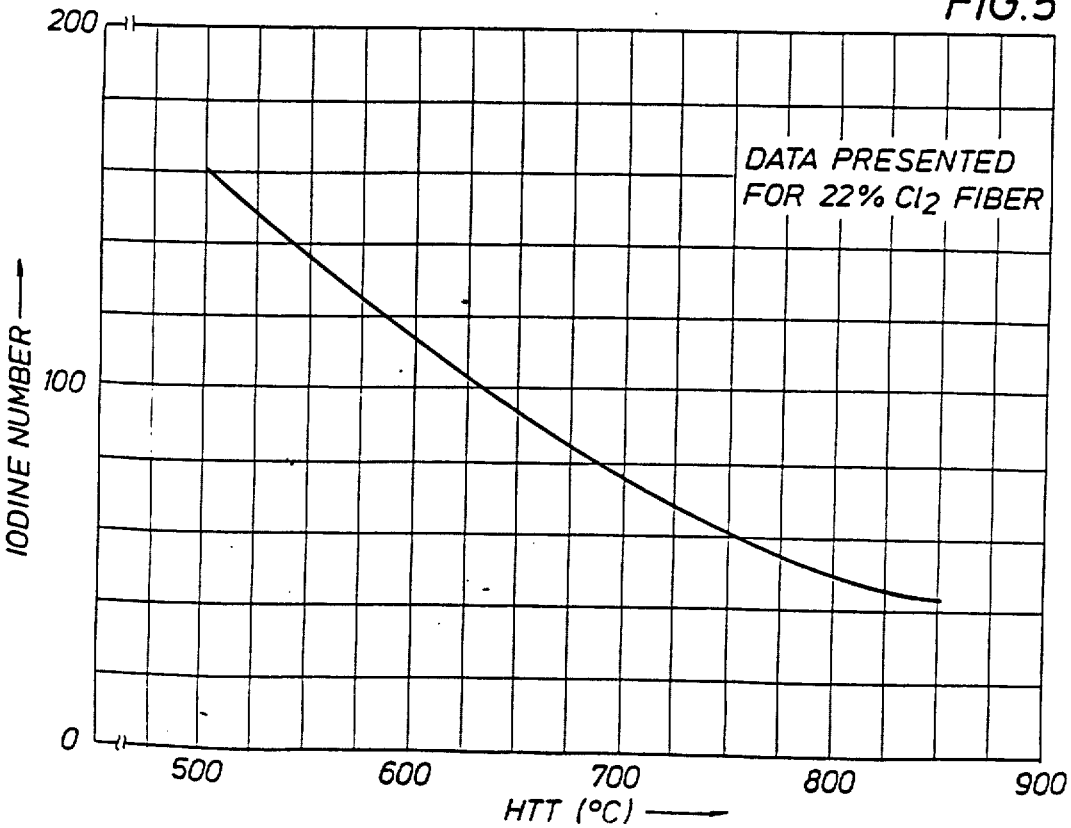
FIG. 5 plots iodine number (inferring surface area) as a function of heat treatment temperature for fibers having a specific weight percent chlorination.

The sheets of drawings consisting of Figs. 1-6, should be added as shown on the attached page.

United States Patent [19]

Krupp et al.

[11] Patent Number: 4,977,023

[45] Date of Patent: Dec. 11, 1990

[54] ELASTIC CARBON FIBERS

[75] Inventors: Stephen P. Krupp, Houston, Tex.; Scott L. Gessner, Greenville, S.C.

[73] Assignee: The Dow Chemical Company, Midland, Mich.

[21] Appl. No.: 221,843

[22] Filed: Jul. 20, 1988

Related U.S. Application Data

[60] Division of Ser. No. 907,931, Sep. 16, 1986, and a continuation-in-part of Ser. No. 700,231, Feb. 11, 1985, abandoned, and a continuation-in-part of Ser. No. 944,479, Dec. 22, 1986.

[51] Int. Cl.[5] ..... D02G 3/00

[52] U.S. Cl. ..... 428/367; 208/22; 208/40; 423/447.1; 423/447.4; 428/408

[58] Field of Search ..... 428/367, 408; 423/447.1, 447.4; 208/22, 40

[56] References Cited

U.S. PATENT DOCUMENTS

| | | | |
|---|---|---|---|
| 4,497,789 | 2/1985 | Sawran et al. | 423/447.4 |
| 4,554,148 | 11/1985 | Gomi et al. | 423/447.1 |
| 4,591,424 | 5/1986 | Gomi et al. | 208/40 |
| 4,671,864 | 6/1987 | Sawran et al. | 208/22 |

*Primary Examiner*—Lorraine T. Kendell

[57] ABSTRACT

A fiber made of pitch is disclosed. In the preferred and illustrated embodiment, the fiber has a percent elongation of about 2 percent or greater. This fiber is made by melt spinning an optically isotropic pitch to form a fiber typically in the range of about 5 to about 50 microns diameter, treating the fiber with an oxidizing atmosphere, subsequently removing a certain portion of the oxidant thereby reducing the weight of the fiber, with the optional post-treatment step of repetitively stretching in the elastic range short of breakage to increase the percent elongation.

17 Claims, 5 Drawings

FIG. 2
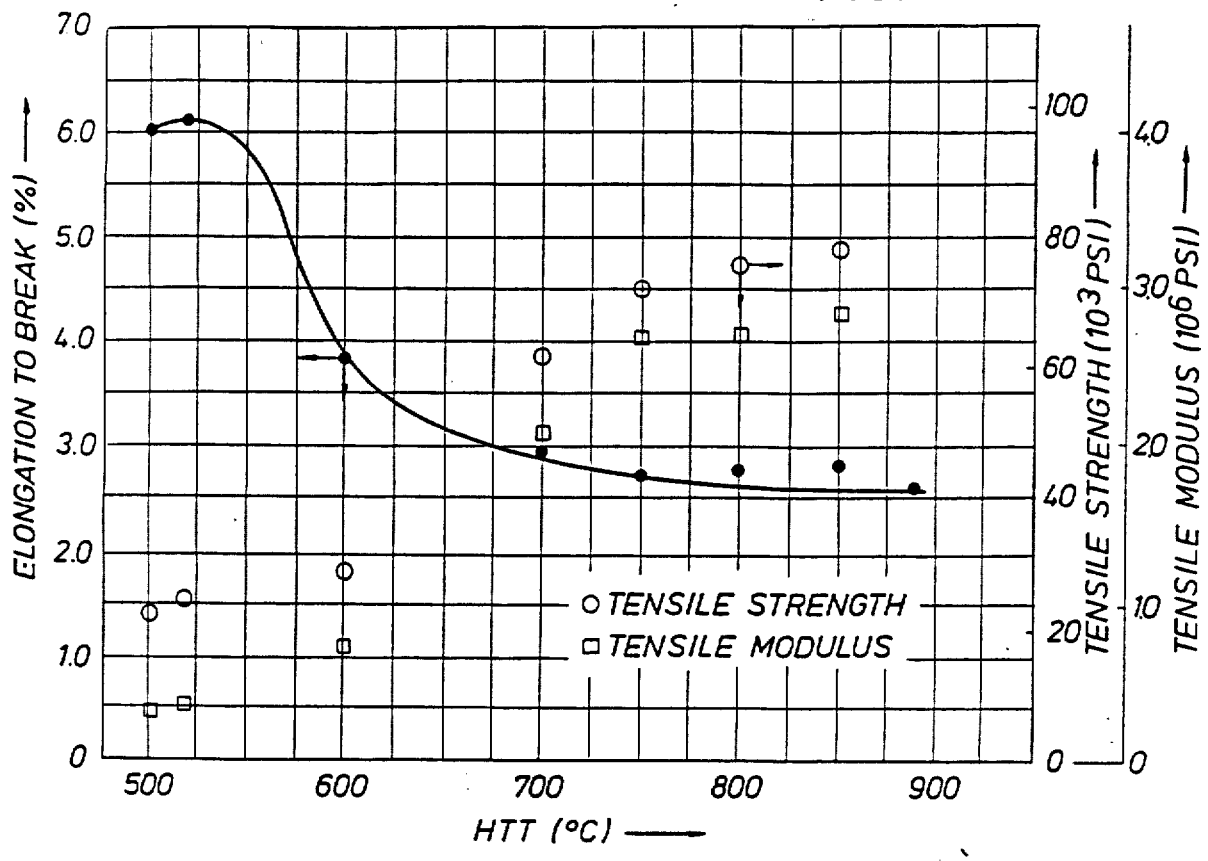
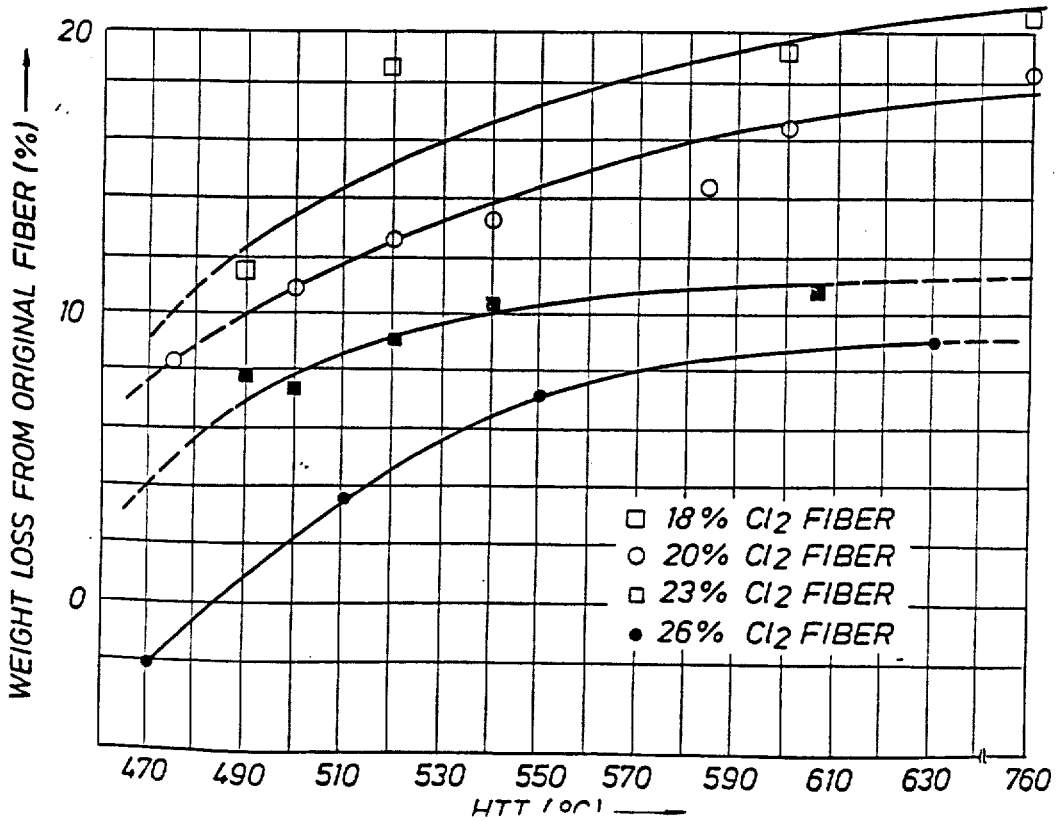
FIG. 3

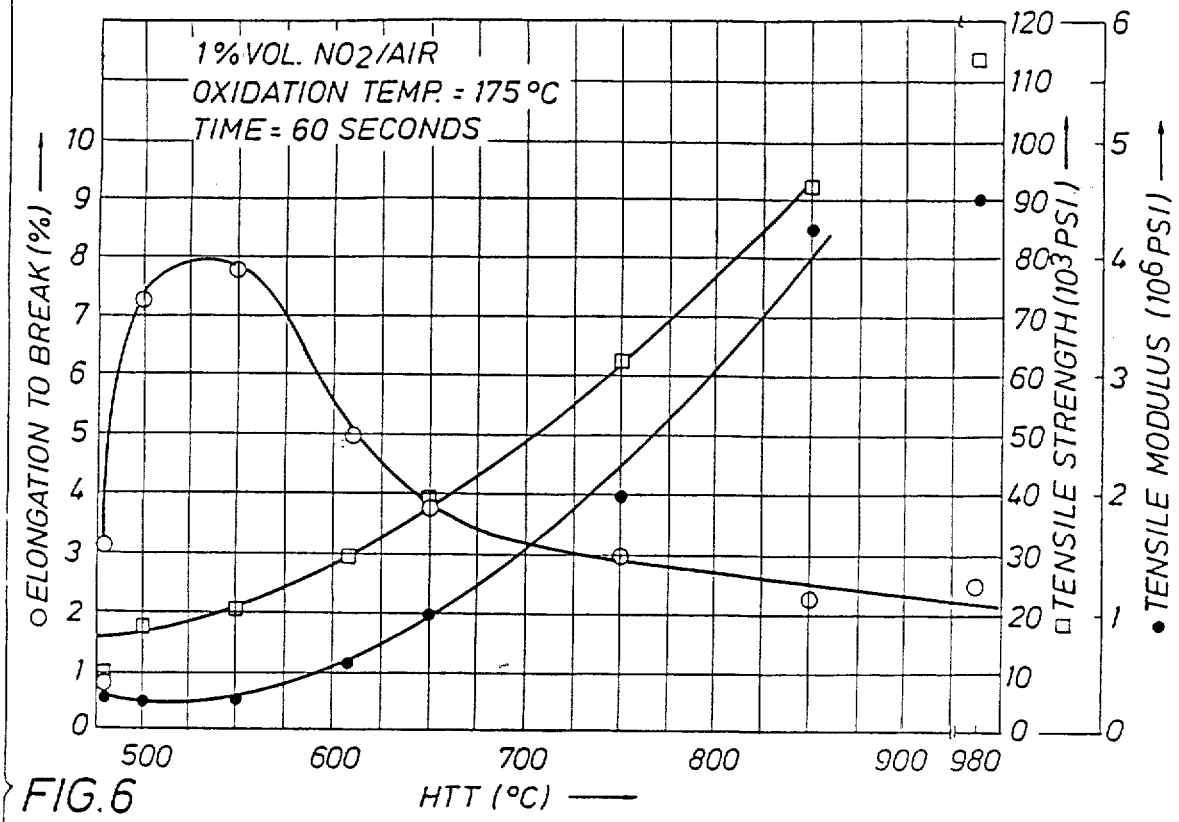
FIG.6
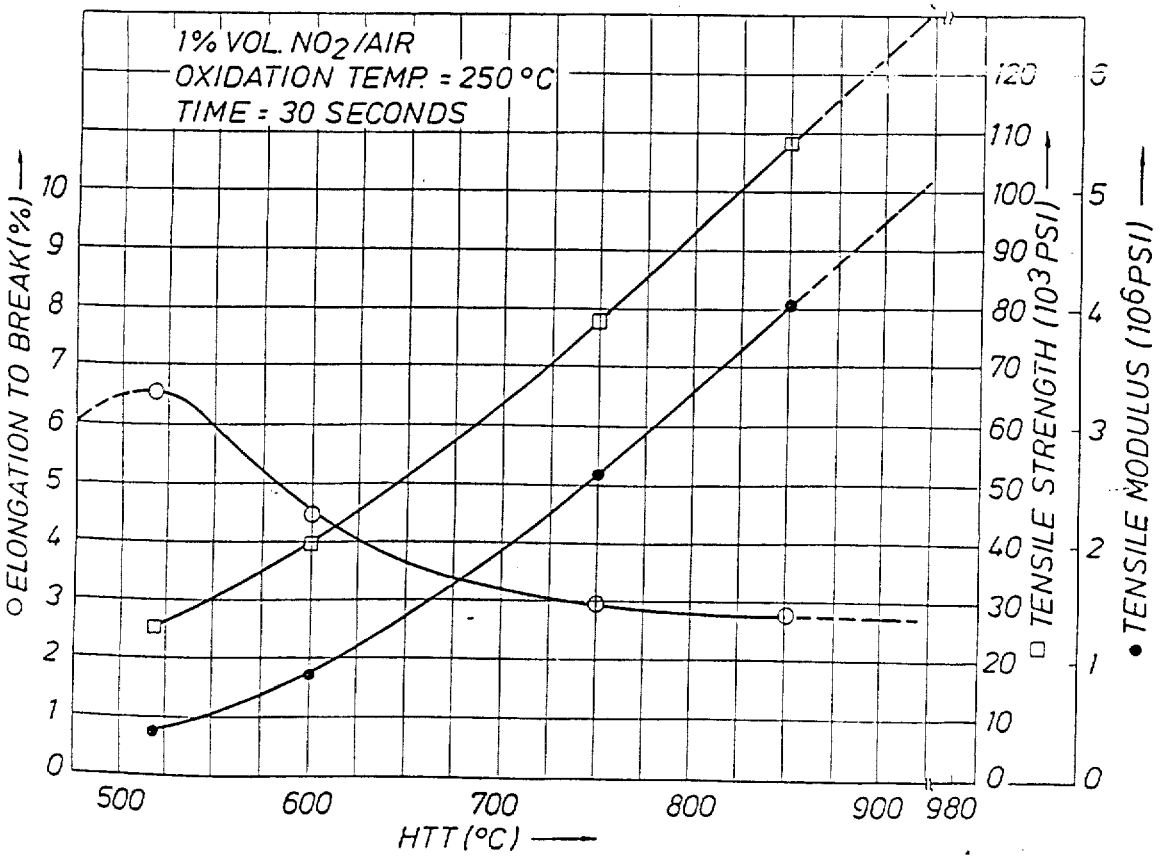

UNITED STATES PATENT AND TRADEMARK OFFICE

CERTIFICATE OF CORRECTION

PATENT NO. : 4,977,023

DATED : December 11, 1990

INVENTOR(S) : Stephen P. Krupp and Scott L. Gessner

It is certified that error appears in the above-identified patent and that said Letters Patent is hereby corrected as shown below:

Column 1, line 45 "elongation The" should read --elongation. The--.

Column 2, lines 10-11 "oxidant is used." should read --oxidant be used.--.

Column 2, line 15 "3 1 to 10" should read --3 to 10--.

Column 2, line 61 "by using substantially" should read --by being substantially--.

Column 3, line 17 "increases In" should read --increases. In--.

Column 3, line 24 "pressure The" should read --pressure. The--.

Column 3. line 26 "minutes This" should read --minutes. This--.

Column 4, line 8 "perhaps 2° C." should read --perhaps 25° C.--.

Column 6, line 1 "application 20 While" should read --application. While--.

Signed and Sealed this

Seventh Day of July, 1992

*Attest:*

DOUGLAS B. COMER

*Attesting Officer*

*Acting Commissioner of Patents and Trademarks*